US008105108B2

(12) United States Patent
Vroom et al.

(10) Patent No.: US 8,105,108 B2
(45) Date of Patent: Jan. 31, 2012

(54) DOCKING STATION FOR PORTABLE ELECTRONICS WITH VOIDS FOR CONNECTOR PASS-THROUGH AND INTEGRAL CONNECTOR FASTENER

(76) Inventors: Matthew Leigh Vroom, Dallas, TX (US); Benjamin Edwards Maskell, Arlington, VA (US)

( * ) Notice: Subject to any disclaimer, the term of this patent is extended or adjusted under 35 U.S.C. 154(b) by 24 days.

(21) Appl. No.: 12/562,121

(22) Filed: Sep. 17, 2009

(65) Prior Publication Data

US 2011/0065314 A1 Mar. 17, 2011

(51) Int. Cl.
*H01R 13/60* (2006.01)

(52) U.S. Cl. ..... 439/540.1; 439/810

(58) Field of Classification Search ..... 439/540.1, 439/299, 300, 807, 810, 811, 812, 813, 814, 439/815

See application file for complete search history.

(56) References Cited

U.S. PATENT DOCUMENTS 2,531,291 A * 11/1950 Olson ..... 439/756
2,903,668 A 9/1959 Cornell
3,727,171 A 4/1973 Coles
3,775,733 A * 11/1973 Ege ..... 439/724
3,781,766 A 12/1973 Teagno
3,816,821 A 6/1974 Rhodes
3,873,172 A 3/1975 Paullus
4,097,113 A 6/1978 Mckelvy
4,178,060 A 12/1979 Coffey
4,387,951 A 6/1983 Hall
4,418,975 A 12/1983 O'Keefe, II
4,490,002 A 12/1984 Fowler
4,659,166 A 4/1987 Morningstar
4,726,789 A 2/1988 Yaffe
4,762,388 A 8/1988 Tanaka
4,836,804 A 6/1989 London
4,842,363 A 6/1989 Margolin
4,870,702 A 9/1989 Azzouni
4,881,910 A 11/1989 Odemer
5,092,788 A 3/1992 Pristupa
5,137,455 A 8/1992 Moerbe
5,186,646 A * 2/1993 Pederson ..... 439/374
2005/0266720 A1 * 12/2005 Lin ..... 439/418

FOREIGN PATENT DOCUMENTS

EP 76657 A2 4/1983

* cited by examiner

*Primary Examiner* — Ross Gushi
(74) *Attorney, Agent, or Firm* — Benjamin E. Maskell

(57) ABSTRACT

Disclosed is a docking station for an electronic device comprising a main body which holds an electronic device and voids in the main body to allow for the passage of external connectors directly into the docked device and the securing of the external connectors to the main body.

20 Claims, 6 Drawing Sheets

DOCKING STATION FOR PORTABLE ELECTRONICS WITH VOIDS FOR CONNECTOR PASS-THROUGH AND INTEGRAL CONNECTOR FASTENER

BACKGROUND OF THE INVENTION

1. Field of the Invention

The embodiments of the invention relate to a cable organizer, and more particularly, to a docking station for portable electronics. Although embodiments of the invention are suitable for a wide scope of applications, it is particularly suitable for facilitating the rapid connection of external connectors to a portable electronic device.

2. Discussion of the Related Art

A docking station for electronic devices refers to a peripheral which facilitates the connection of external connectors to a portable device. Such docking stations usually contain electronic connectors integrated into the body of the docking station that mate with the ports on the docked device. Output ports on the main body of the docking station essentially replicate the ports on the electronic device. The user can then attach connectors for external devices to the output ports of the docking station. Such docking stations are useful because they facilitate the easy insertion and removal of an electronic device without the need to individually connect and disconnect cables for external devices.

Despite the time-saving efficiencies of prior art docking stations, the unnecessary duplication of ports increases the materials costs and manufacturing labor costs. Additionally, certain proprietary ports, by virtue of manufacturer's patent rights, cannot be duplicated without a license. Through extended use, individual ports and connectors can become worn and dysfunctional. When a single component of the docking station is broken, the entire dock must be replaced. Finally, duplication of ports contributes to the deterioration of signal integrity.

SUMMARY OF THE INVENTION

Accordingly, embodiments of the invention are directed to a docking station for portable electronics with voids for connector pass-through and integral connector fastener that substantially obviates one or more of the problems due to limitations and disadvantages of the related art.

An object of embodiments of the invention is to provide a docking station without integral connectors Another object of embodiments of the invention is to provide a docking station with integral cable fasteners.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, the docking station for portable electronics with voids for connector pass-through and integral connector fastener includes an apparatus for attaching an external connector to an electronic device comprising a main body which interfaces with an electronic device, at least one void in the main body each of which allows the passage an external connector directly into the electronic device, and an integral fastener which secures the external connector to the main body.

In another aspect, a docking station for portable electronics with voids for connector pass-through and integral connector fastener includes a method for attaching an external connector to an electronic device, the method comprising inserting an external connector into at least one void in a main body of an apparatus, securing the external connector to the main body with an integral fastener, and inserting an electronic device into the apparatus such that the external connector secured in the main body connects to a port on the electronic device.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention.

DETAILED DESCRIPTION OF THE PREFERRED EMBODIMENTS

Figure 1:
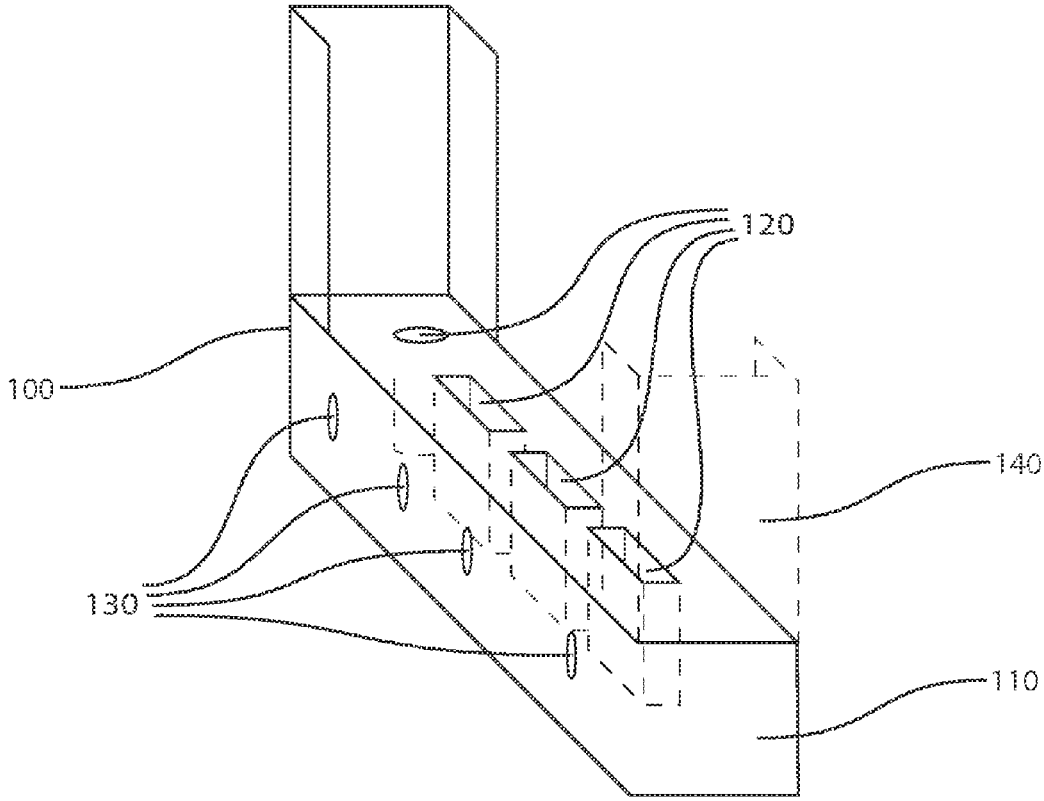
FIG. 1 is a schematic drawing illustrating the shape and location of voids in an exemplary embodiment of the present invention.

Reference will now be made in detail to the preferred embodiments of the invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, the thicknesses of layers and regions are exaggerated for clarity. Like reference numerals in the drawings denote like elements.

Figure 2:
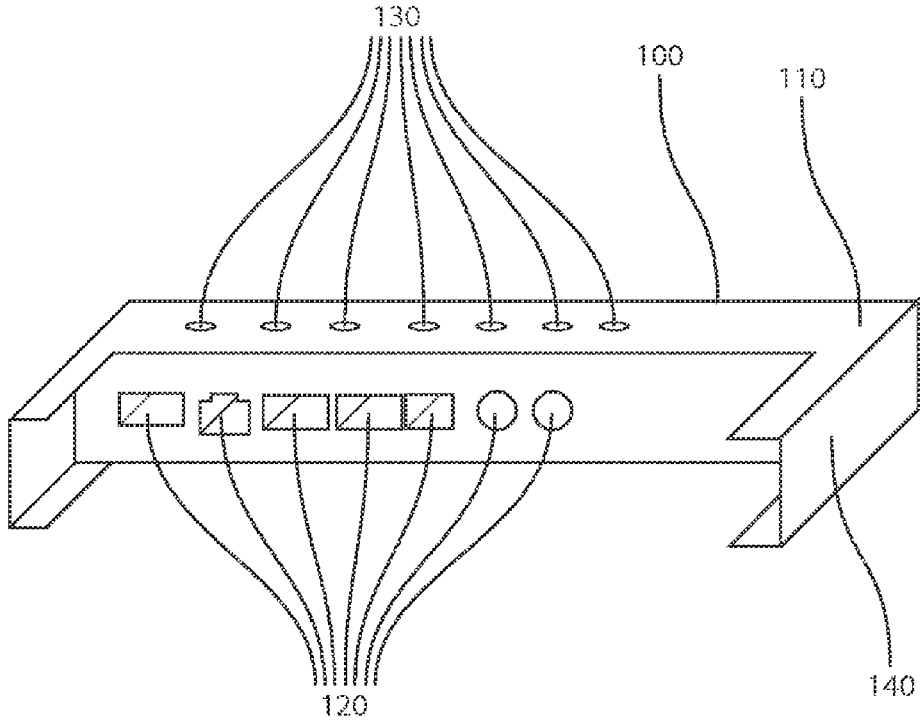
FIG. 2 is a schematic drawing illustrating the shape and location of voids in an exemplary embodiment of the present invention.

As shown in FIG. 1 and FIG. 2, an exemplary embodiment of the docking station for an electronic device (docking station) 100 includes a main body 110 and a plurality of voids 120. The voids 120 are positioned in the main body 110 such that they align with the ports on a specific electronic device (not shown for clarity.) The voids 120 each have an integral fastener 130 for securing external connectors (not shown for clarity.) The main body 110 optionally includes support guides 140 for aiding in the insertion, alignment, and stability of an electronic device (not shown for clarity) inserted into the docking station 100.

External connectors are electrical connector that attach to ports on the electronic device. External connectors can be USB, VGA, ⅛" audio, power, HDMI, DVI, Display Port, Mini Display Port, serial or Firewire. External connectors proprietary to Apple are also contemplated including the MagSafe connector. While specific types of external connectors have been named, other types of external connectors can also be used with the present invention.

Figure 3:
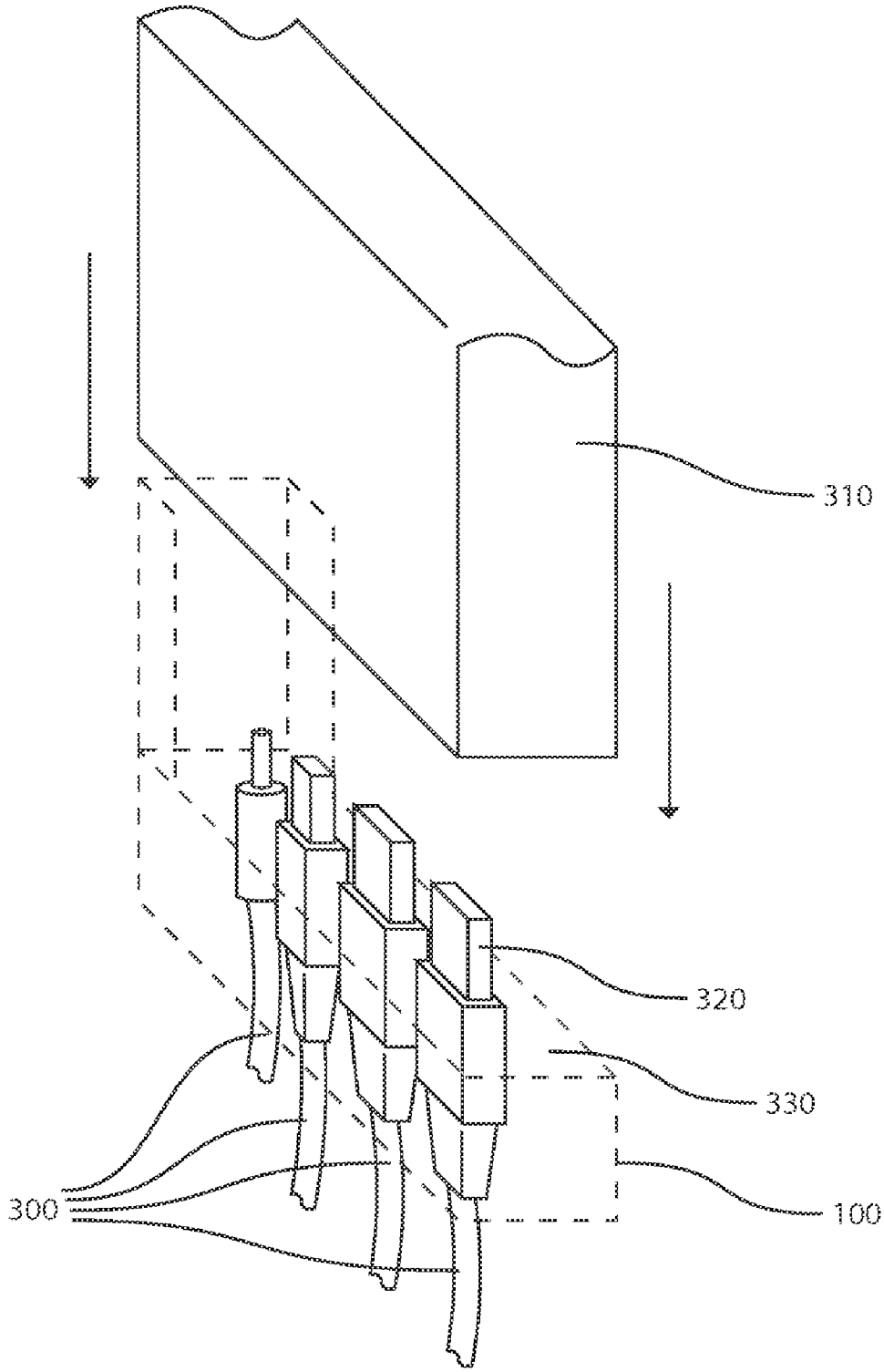
FIG. 3 is a schematic drawing illustrating external connectors passing through voids and secured to the docking station and the insertion of an electronic device.

FIG. 3 shows external connectors 300 inserted into the docking station 100 and the insertion an electronic device 310. The depth which external connectors 300 are inserted into the docking station 100 is to be determined by the user. In practice, the depth chosen by the user will be sufficient to allow the electrical contacts 320 of the external connectors 300 to protrude from the main body 330 and engage the ports of the electronic device 310.

One method for the user to determine the optimal insertion depth for the external connectors 300 is to insert the electronic device 310 into the docking station 100 before inserting the external connectors 300. After the electronic device 310 is inserted, the user can insert the external connectors 300. Optimal insertion depth of the external connectors 300 is achieved when the external connectors 300 are fully engaged with the ports on the electronic device 310. The external connectors can now be secured to the docking station 100 with a fastener (not shown for clarity.) When the electronic device 310 is removed, the external connectors 300 are held in place by the fasteners and are optimally positioned for subsequent reinsertion of the electronic device 310.

The electronic device 310 can be an Aluminum Unibody Macbook Pro. While an Aluminum Unibody Macbook Pro is contemplated, the present invention is equally applicable to other electronic devices including laptops, cell phones, and PDAs.

Figure 4A:
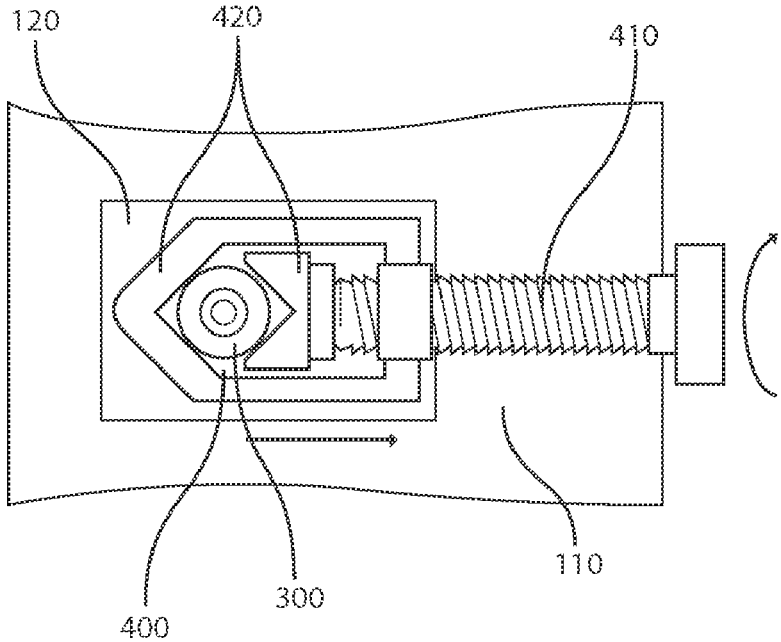
FIG. 4A is a schematic drawing illustrating a top-view of a caliper-style fastener.

FIG. 4A shows a top-view of a caliper-style means for fastening an external connector 300 to the main body 110 of the docking station. The external connector 300 passes through a void 120 into the aperture 400 of the caliper. When the fastener is activated, in this case by tightening a screw 410, the jaws 420 are drawn together, securing the external connector 300.

Figure 4B:
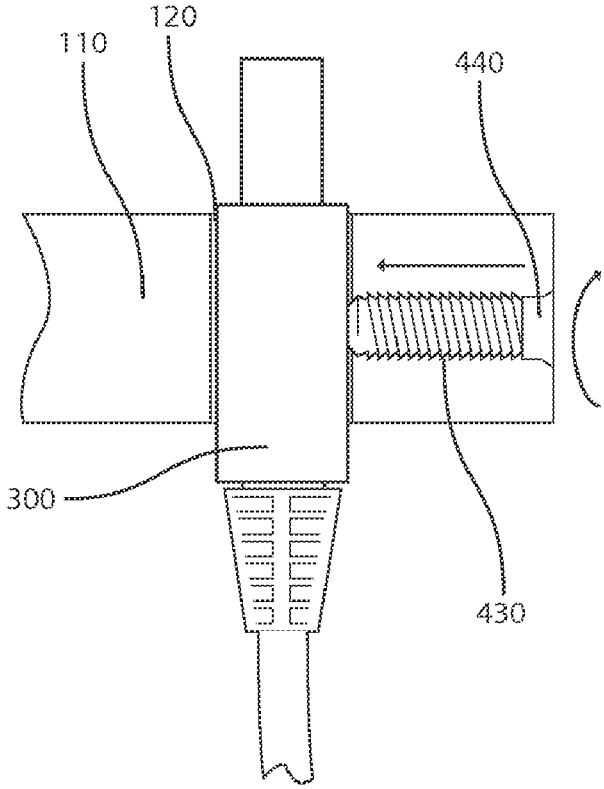
FIG. 4B is a schematic drawing illustrating a side-view of a setscrew-style fastener.

FIG. 4B shows a side-view of a setscrew-style means for fastening an external connector 300 to the main body 110 of the docking station. The external connector 300 passes through a void 120 and is secured to the main body 110 by tightening a setscrew 430. Tightening the setscrew 430 pushes the external connector into the opposite wall of the void 120 causing sufficient friction to hold the external connector 300 fast. In some embodiments, the pilot hole 440 is sized to accommodate a 0.25" diameter, 20 TPI setscrew. Setscrews of other dimensions are contemplated to accommodate varying sizes of external connectors and provide maximum resistance to stripping the threads of pilot hole 430.

Figure 4C:
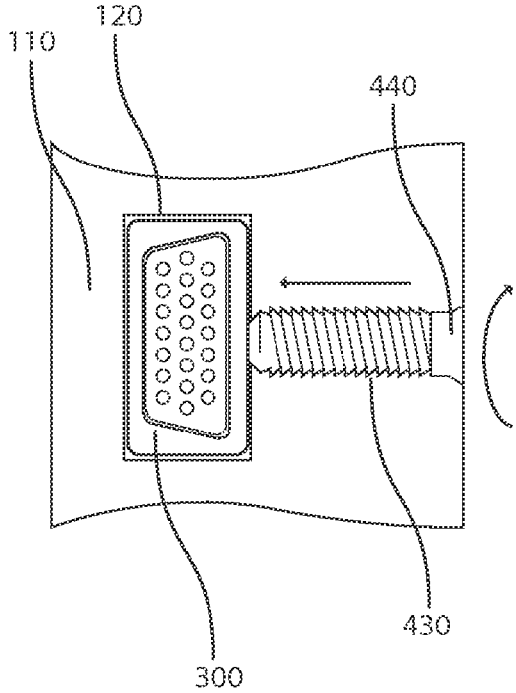
FIG. 4C is a schematic drawing illustrating a top-view of a setscrew-style fastener.

FIG. 4C shows a top-view of a setscrew-style means for fastening an external connector 300 to the main body 110 of the docking station. The external connector 300 passes through a void 120 and is secured to the main body 110 by tightening a setscrew 430. Tightening the setscrew 430 pushes the external connector into the opposite wall of the void 120 causing sufficient friction to hold the external connector 300 fast. The pilot hole 440 is sized to accommodate a 0.25" diameter, 20 TPI setscrew.

Cup-style setscrews having a hemispherical indentation in the end and are particularly suited for this purpose because the sharp edges of the hemisphere indentation impress slightly on the ferrule of the external connector 300 creating a positive connection between the external connector 300 and the fastener. While cup-style setscrews with 0.25" diameter and 20 TPI have been shown and described in this exemplary embodiment, nearly any type of screw capable of securing the external connectors 300 would sufficiently enable the invention. Obviously, one of ordinary skill in the art would recognize that other screws can be used without departing from the spirit of the instant invention. Thumb screws provide an advantage over setscrews by allowing for the toolless installation and removal of external connectors although at higher materials cost.

The main body 110 can be made from injection molded ABS plastic according to common methods known in the art of injection molding. The main body 110 can be formed from a single piece of plastic. Alternatively, the main body 110 can be formed in two halves which are glued or screwed together after molding. Holes 440 for fasteners 430 and voids 120 for external connectors 300 can be created as part of the injection molding process or by post-process machining. Although plastic has been disclosed as a preferred structural material for the main body, other materials are also contemplated including aluminum alloys, steel alloys, and wood. Such materials can be selected based upon their mechanical and aesthetic properties.

Figure 4D:
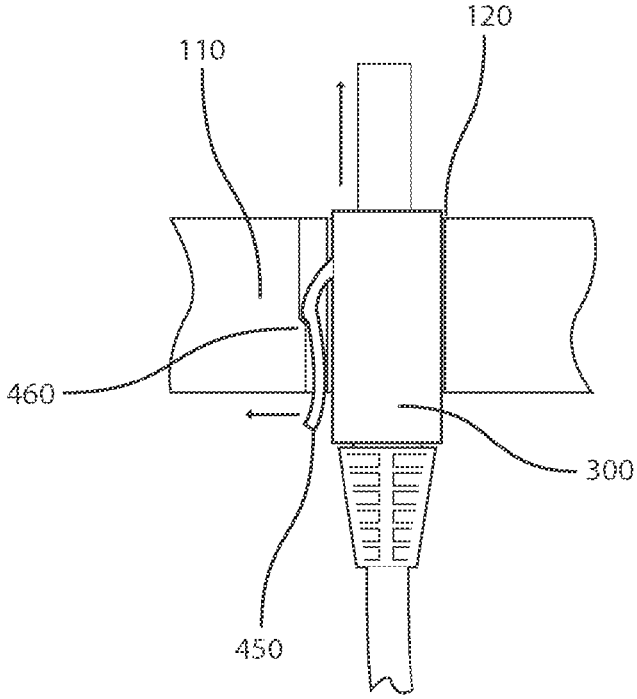
FIG. 4D is a schematic drawing illustrating a self-locking connector fastener.

FIG. 4D shows a side-view of a self-locking connector means for fastening an external connector 300 to the main body 110 of the docking station. The external connector 300 passes through a void 120 and is secured to the main body by a locking tab 450 which engages an indentation 460 in the void 120. Removal is facilitated by depressing the locking tab 450 to disengage it from the indentation 460.

Figure 5:
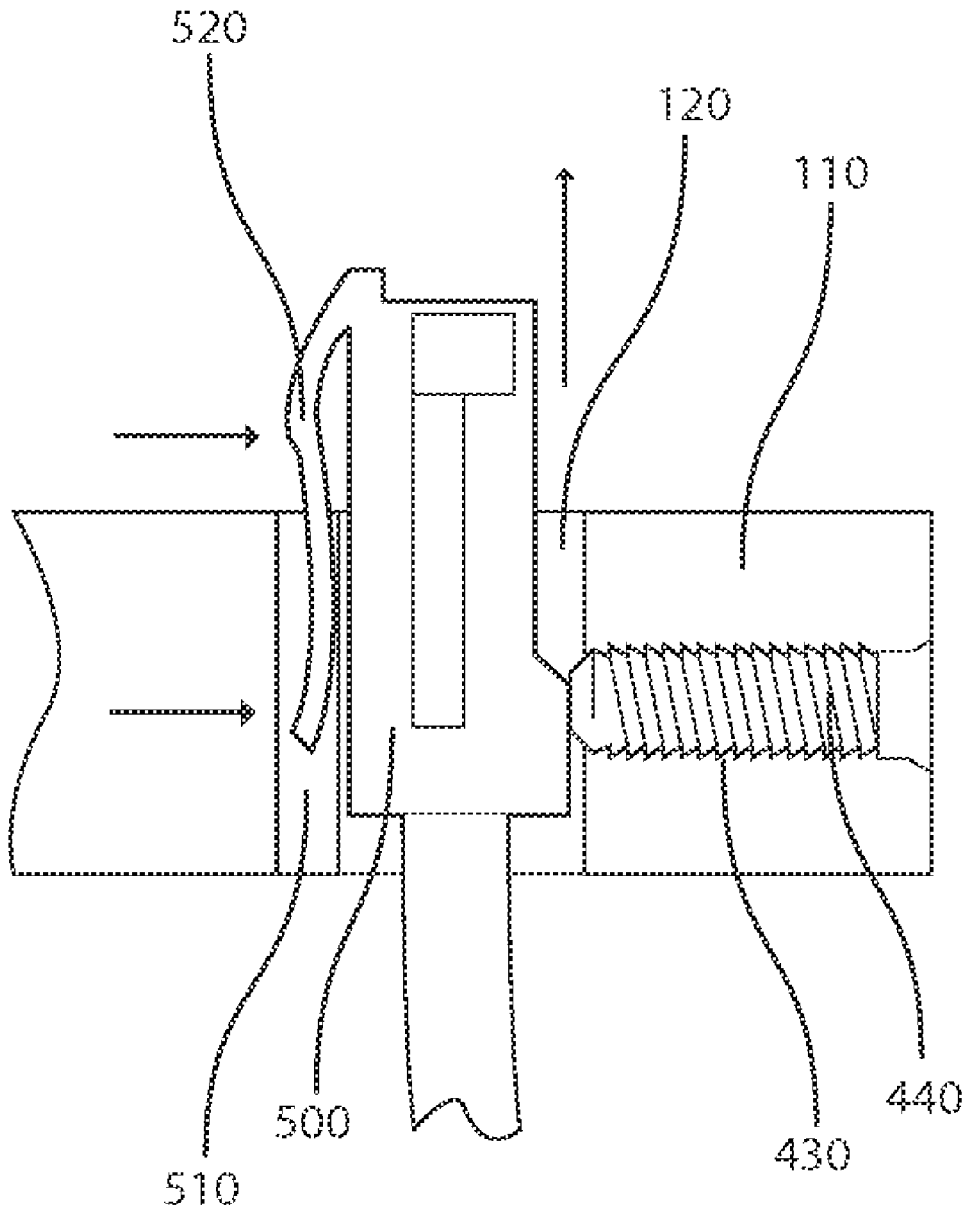
FIG. 5 is a schematic drawing illustrating a void for an Ethernet connector.

FIG. 5 shows a side-view of a void 120 specifically designed to accommodate an external RJ-45 (Ethernet) connector 500. The void 120 has a channel 510 to accommodate the self-locking tab 520 of the Ethernet connector. The channel is sized such that the self-locking tab 520 is depressed and thereby deactivated when inserted into the main body 110. This design prevents the Ethernet connector 500 from locking to an electronic device (not shown) inserted into the docking station. The connector 520 can then be secured to the main body 110 by employing a fastener 430.

Figure 6A:
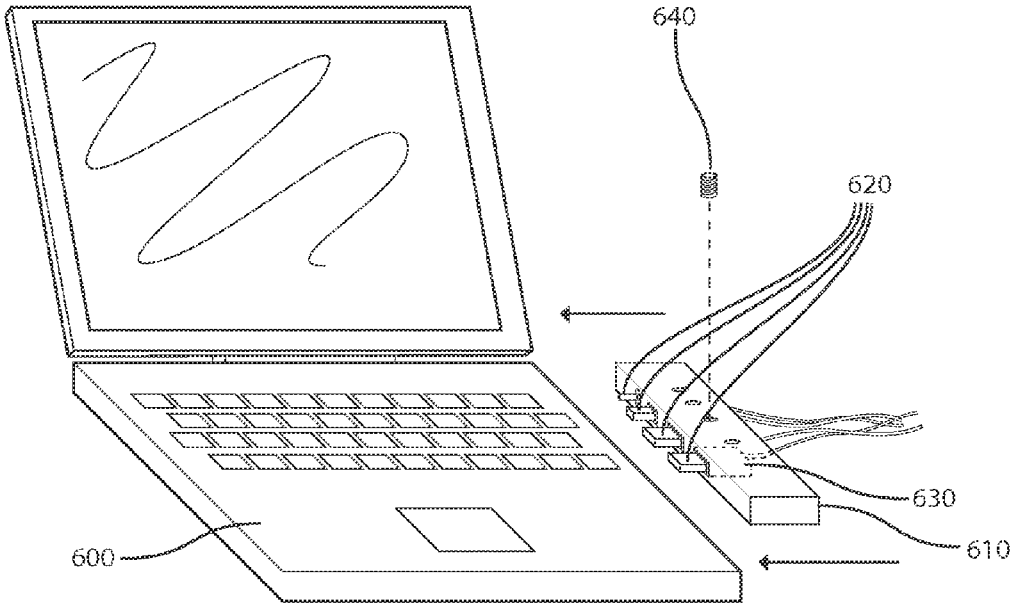
FIG. 6A is a schematic drawing illustrating an electronic device interfacing with an exemplary embodiment of the present invention.
Figure 6B:
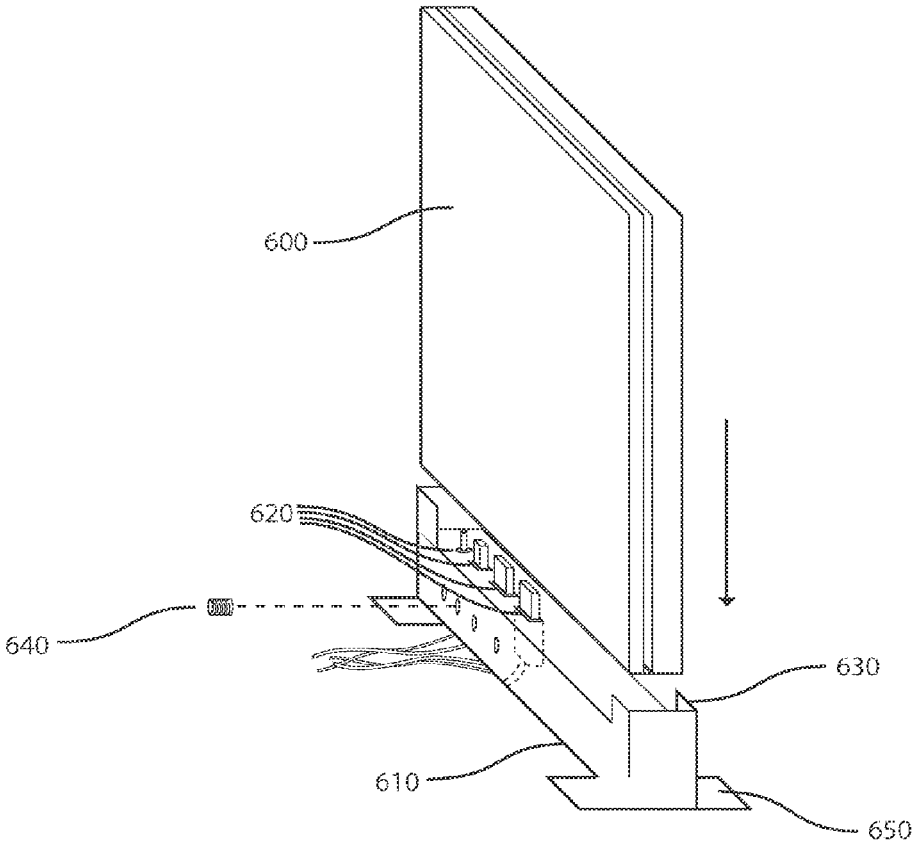
FIG. 6B is a schematic drawing illustrating an electronic device interfacing with an exemplary embodiment of the present invention.

FIGS. 6A and 6B show an electronic device 600 interfacing with an exemplary embodiment 610 of the present invention. External connectors 620 pass through voids 630 in the main body and are secured using a fastener 640. In an exemplary embodiment, the docking station can be oriented vertically as shown in FIG. 6B. In a vertical orientation, a stabilizing means 650 maintains the docking station 610 and electronic device 600 in the desired orientation.

It will be apparent to those skilled in the art that various modifications and variations can be made in the docking station for portable electronics with voids for connector pass-through and integral connector fastener of embodiments of the invention without departing from the spirit or scope of the invention. Thus, it is intended that embodiments of the invention cover the modifications and variations of this invention provided they come within the scope of the appended claims and their equivalents.

What is claimed is:

1. An apparatus for attaching a plurality of external connectors to an electronic device, the apparatus comprising:

a main body which holds the plurality of external connectors and interfaces with the electronic device;

a plurality of voids in the main body;

a first external connector of the plurality of external connectors;

a first void of the plurality of voids which allows the passage of the first external connector of the plurality of external connectors directly into the electronic device, wherein the first void is larger than a housing of the first external connector; and an integral fastener which secures the first external connector to the main body.

2. The apparatus of claim 1 wherein the fastener is a setscrew.

3. The apparatus of claim 1 wherein the fastener is a thumbscrew.

4. The apparatus of claim 1 wherein the fastener is a self-locking connector.

5. The apparatus of claim 1 wherein the fastener is a caliper.

6. The apparatus of claim 1 wherein the positioning of the first void corresponds with the position of a port on the electronic device.

7. The apparatus of claim 1 wherein the shape of the first void corresponds with the shape of the external connector.

8. The apparatus of claim 1 wherein the main body is formed from a single piece of material.

9. The apparatus of claim 8 wherein the material is plastic.

10. The apparatus of claim 1 wherein the external connector is a USB plug.

11. The apparatus of claim 1 wherein the external connector is a ⅛" audio connector.

12. The apparatus of claim 1 wherein the external connector is a Mini DisplayPort plug.

13. The apparatus of claim 1 wherein the external connector is a magnetic connector.

14. A method for attaching an external connector to an electronic device, the method comprising:

inserting an external connector into a void in a main body of an apparatus;

securing the external connector to the main body with an integral fastener;

inserting an electronic device into the apparatus such that the external connector secured in the main body connects to a port on the electronic device; and wherein the void is larger than a housing of the external connector.

15. The method of claim 14 wherein the fastener is a setscrew.

16. The method of claim 14 wherein the fastener is a thumbscrew.

17. The method of claim 14 wherein the fastener is a self-locking connector.

18. The method of claim 14 wherein the fastener is a caliper.

19. The method of claim 14 wherein the positioning of the void corresponds with the position of a port on the electronic device.

20. The method of claim 14 wherein the shape of the void corresponds with the shape of the external connector.

* * * * *